US008790002B2

(12) United States Patent
Lee

(10) Patent No.: US 8,790,002 B2
(45) Date of Patent: Jul. 29, 2014

(54) APPARATUS FOR MIXING

(75) Inventor: Charles Lee, Worcestershire (GB)

(73) Assignee: Matcon Ltd., Worcestershire (GB)

( * ) Notice: Subject to any disclaimer, the term of this patent is extended or adjusted under 35 U.S.C. 154(b) by 0 days.

(21) Appl. No.: 13/106,292

(22) Filed: May 12, 2011

(65) Prior Publication Data

US 2012/0287747 A1 Nov. 15, 2012

(30) Foreign Application Priority Data

May 12, 2010 (GB) ..... 1007941.6

(51) Int. Cl.
*B01F 9/08* (2006.01)

(52) U.S. Cl.
USPC ..... 366/201; 366/213

(58) Field of Classification Search
USPC ..... 366/200–201, 213, 217
See application file for complete search history.

(56) References Cited

U.S. PATENT DOCUMENTS

| | | | | | |
|---|---|---|---|---|---|
| 5,601 | A | * | 5/1848 | Young | 366/200 |
| 1,755,763 | A | * | 4/1930 | Barber | 134/150 |
| 1,898,365 | A | * | 2/1933 | Harding | 366/200 |
| 1,977,419 | A | * | 10/1934 | Adams et al. | 366/200 |
| 3,315,945 | A | * | 4/1967 | Schmitt | 366/200 |
| 3,374,584 | A | * | 3/1968 | Haught | 451/328 |
| 4,004,783 | A | * | 1/1977 | Wilson | 366/200 |
| 4,041,648 | A | * | 8/1977 | Heiberger | 451/329 |
| 4,100,616 | A | * | 7/1978 | Wilson | 366/213 |
| 4,432,650 | A | * | 2/1984 | Langen et al. | 366/147 |
| 4,468,129 | A | * | 8/1984 | McIntosh et al. | 366/213 |
| 5,704,711 | A | * | 1/1998 | Simmons | 366/199 |
| 5,769,537 | A | * | 6/1998 | Stromberg et al. | 366/163.1 |
| 5,865,538 | A | * | 2/1999 | Walker et al. | 366/197 |
| 7,160,023 | B2 | * | 1/2007 | Freude et al. | 366/273 |
| 7,284,900 | B2 | * | 10/2007 | Mayer | 366/197 |
| 7,325,969 | B2 | * | 2/2008 | Kretzschmar et al. | 366/217 |
| 7,347,613 | B2 | * | 3/2008 | Ditzig et al. | 366/224 |
| 7,476,018 | B2 | * | 1/2009 | McGill et al. | 366/197 |
| 8,157,436 | B2 | * | 4/2012 | Curtis et al. | 366/217 |
| 8,177,417 | B2 | * | 5/2012 | Ditzig et al. | 366/219 |

FOREIGN PATENT DOCUMENTS

| | | |
|---|---|---|
| JP | 2003144893 | 5/2003 |
| JP | 2006320824 | 11/2006 |

* cited by examiner

*Primary Examiner* — David Sorkin
*Assistant Examiner* — Abbas Rashid
(74) *Attorney, Agent, or Firm* — Howard & Howard Attorneys PLLC

(57) ABSTRACT

An Apparatus for mixing, comprising a tumble-blender adapted to receive and tumble a container to mix the contents of the container. The apparatus includes a drive means for driving a mixer of the container. The drive means is adapted to dock with the mixer when the container is received by the tumble-blender to enable operation of the mixer by the drive means. The drive is movably mounted, relative to the tumble-blender, to facilitate docking of the drive means with the mixer.

16 Claims, 13 Drawing Sheets

B-B

APPARATUS FOR MIXING

CROSS-REFERENCE TO RELATED APPLICATION

This patent application claims priority to Great Britain Patent Application Serial No. GB1007941.6 filed May 12, 2010, entitled: "APPARATUS FOR MIXING".

FIELD OF INVENTION

The invention relates to apparatus for mixing the contents of a storage or containment container, in-situ in the container.

BACKGROUND OF THE INVENTION

Apparatus for mixing the contents of storage and containment devices such as IBCs (Intermediate Bulk Containers) in-situ in the container is known. It provides the advantage that the constituents of mixtures such as foodstuffs and pharmaceuticals can be mixed in-situ in the container in which they are being stored and/or transported without the need to transfer them to a separate mixer and back again, thus saving time and expense. It also removes the need for cleaning of the mixing device before processing of the next mixture can occur, also saving time. Generally, such devices operate by moving the container including the contents relative to a fixed support, supported for example on the ground, so that the contents moves inside the container and mixing occurs. An effective form of movement can be rotation of a container such as an IBC, end over end. In the art, such processes are commonly called tumble blending.

Known tumble blending apparatus can suffer from some disadvantages in some specific uses. For example, complete mixing of some constituent types is sometimes difficult to achieve for the very reason that the apparatus is only capable of mixing by movement of the entire container, and this can be a limitation on the utility of such devices when the constituents include particulates and fats. Also, with tumble blending there can be a tendency for the tumbling action to create balls of fat-rich powder which do not become homogeneously mixed. Incomplete mixing can also occur if insufficient airspace (known as ullage) is left in the container because the space available for movement of the contents is limited.

Recently it has been suggested that problems such as these could be overcome if more conventional mixing procedures, such as for example high, shear mixing, could be used in combination with tumble blending. However, a problem lies in how to incorporate such procedures into a tumble blender type device without sacrificing its many advantages or compromising its operation.

Furthermore, it is often required to add constituents whilst mixing is proceeding, which clearly presents some unique challenges if the container to which the constituents must be added is large and heavy and rotating at speed.

The present invention seeks to address problems such as these.

SUMMARY OF THE INVENTION

According to the invention there is provided apparatus for mixing, comprising a tumble blender adapted to receive and tumble a container to mix the contents of the container, the apparatus including drive means for driving a mixer of the container, the drive means being adapted to dock with the mixer when the container is received by the tumble blender to enable operation of the mixer by the drive means, the drive means being movably mounted, relative to the tumble blender, to facilitate docking of the drive means with the mixer. It has been found that this expedient helps to ensure accurate docking.

It is preferred that the drive means is adapted to drive a rotatable mixer of the container. It has been found that adding the mixing action of a rotatable mixer, such as a high-shear mixer, is a particularly effective addition to tumble blending.

It is further preferred that the drive means is movable by a part of the mixer of the container on docking. Thus, correct alignment of the mixer with the drive means is achieved through and by virtue of the docking action.

The apparatus may include means to prevent movement of the drive means relative to the blender, after docking has occurred. Thus, the weight of the drive is not borne solely by the mixer during the tumbling/mixing operation.

The tumble blender may include receiving means for receiving the container for tumble blending, the receiving means being mounted to a non-moving support to move the container on an asymmetric axis. The receiving means may comprise a frame, the frame being adapted to clamp containers of different sizes. Clamping may be hydraulically effected by moving a part or parts of the frame relative to other parts and thus, containers of different sizes may be accommodated. In such an arrangement, docking is preferably achieved during and by virtue of the operation in which the container is clamped in the apparatus prior to and for the purpose of tumbling.

In an alternative embodiment the apparatus may further comprise a closure adapted to obturate an aperture of a container for mixing, the closure including a mixer for mixing the contents of the container, the drive means being adapted to dock with the mixer when the container is received by the tumble-blender to enable operation of the mixer by the drive means. As before, the mixing means preferably comprises a rotatable mixer.

It is convenient for the drive means and the mixer to include mutually interengagable and releasable rotational coupling means, and to include means adapted to provide for correct engagement of the coupling means, and indeed, correct rotational adjustment of the rotational coupling means where the mixer is a rotatable mixer.

The means adapted to provide for correct engagement may comprise a sensor to sense the relative positions of the rotational coupling means, and control means adapted to control the speed of rotation of the drive means on start-up such that correct rotational adjustment of the coupling means occurs.

It is particularly preferred that the rotational coupling means comprises, on the drive means, a linearly reciprocable drive-shaft rotatable about on axis of rotation and including one or more projection projecting substantially parallel with the said axis of rotation, and on the blade means, a rotatable drive shaft comprising one or more lug disposed to mesh with the projection when correct rotational adjustment is achieved, the sensor means being adapted to sense the position of a part of the coupling means along the said axis of rotation.

In a further alternative embodiment the closure may include means for fluid dosing of the container, which means may include a nozzle, the nozzle comprising an inlet for fluid, the nozzle being in fluid communication with at least one port for dosing of fluid into the container, and a closure for the ports, operable to close the ports from within the nozzle.

BRIEF DESCRIPTION OF DRAWINGS

The invention will further be described by way of example and with reference to the following illustrated in the following figures, in which.

DETAILED DESCRIPTION

Figure 1:
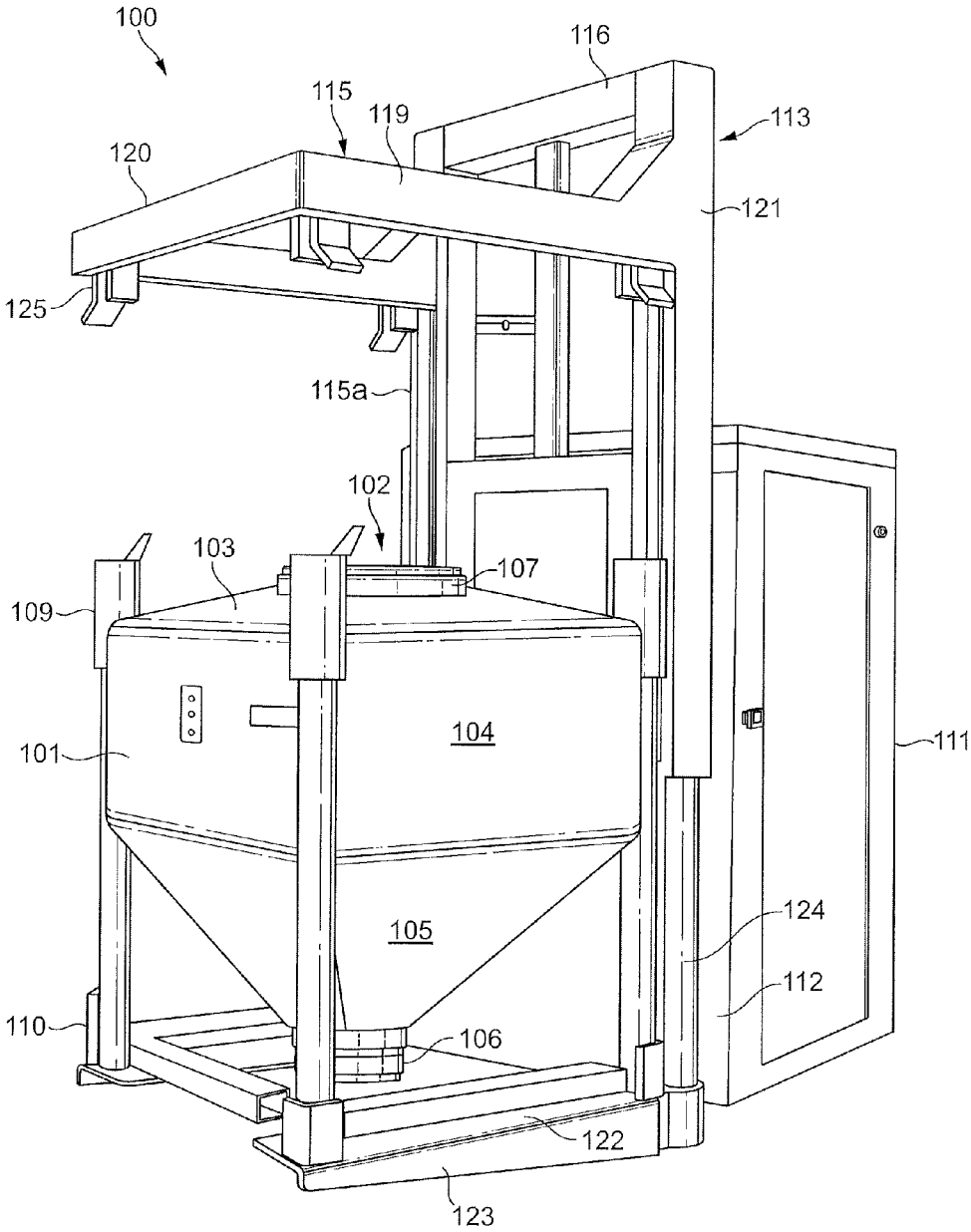
FIG. 1 (Prior Art)
FIG. 1 is a front perspective view of prior art apparatus.

Referring to the Figures, and in particular to FIGS. 1 and 2*a* to 2*d*, there is illustrated known apparatus 100 for mixing contents contained in a storage or transport container 101 in-situ in the container. FIG. 1 shows a container 101 of a known configuration, referred to as an Intermediate Bulk Container, or IBC. The IBC is shown in place on apparatus 100 in order to illustrate the functioning of the apparatus 100, but the IBC does not form part of the apparatus 100. The IBC has an inlet 102 located on a top surface 103, a square section main body part 104 and a lower section 105 in the form of an inverted truncated pyramid. An outlet 106 is located at the bottom, as viewed, of the lower section 105. The top of the IBC is normally obturated by a simple lid closure 107 and the outlet 106 is obturated by a conical valve 108 that can be raised into the lower section 105 to allow mass flow out of the container. The IBC also includes top and bottom stacking features, 109, 110.

The schematic sequence shown in FIGS. 2*a* to 2*d* illustrates operation of the apparatus 100. Firstly, an IBC 101 is placed by suitable means such as a fork-lift so that it rests upon lower frame 122, with bottom stacking features 110 and locating formations 125 in register and the outlet 106 of the container located in locator 123, which is the primary locator for accuracy. The IBC is then clamped in place by activating the hydraulic rams to move the lower frame aims 123 towards the upper frame 115, bringing top stacking features 109 and locating formations 125 into register and securing the IBC in place so that it cannot move relative to the cage 113. The cone valve 108 is clamped in place, for example by vacuum, and sensors (not shown) verify that a top lid closure 107 is in place. The apparatus 100 also includes a switch (not shown) activated only when the IBC is in place and a clamp pressure monitor (not shown).

Figure 2A:
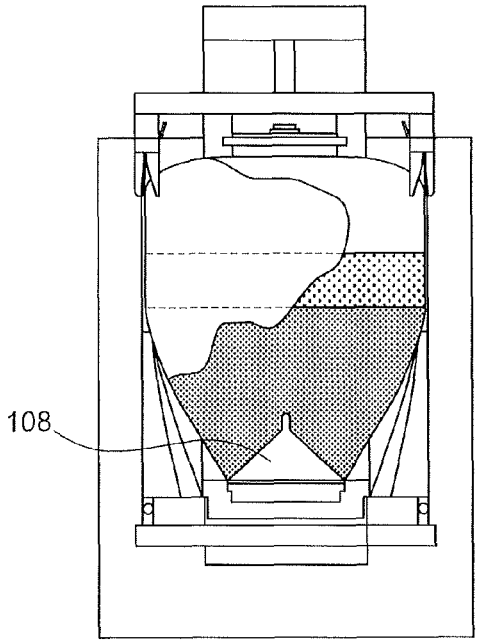
FIG. 2a (Prior Art)
FIGS. 2*a* to 2*d* are a schematic representation of the apparatus of FIG. 1 in use.
Figure 2B:
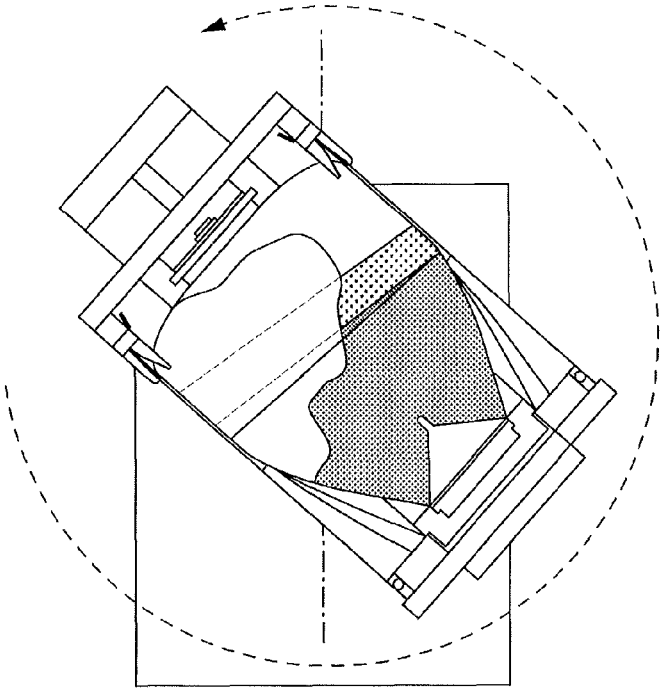
FIG. 2b (Prior Art)
Figure 2C:
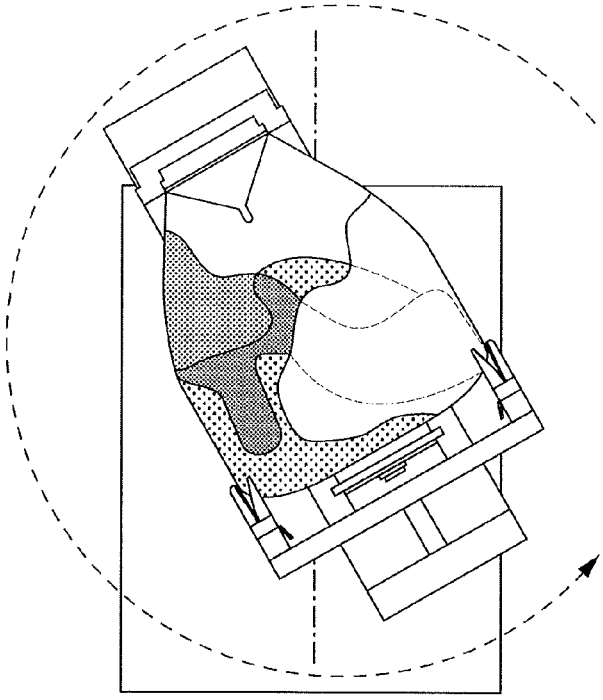
FIG. 2c (Prior Art)
Figure 2D:
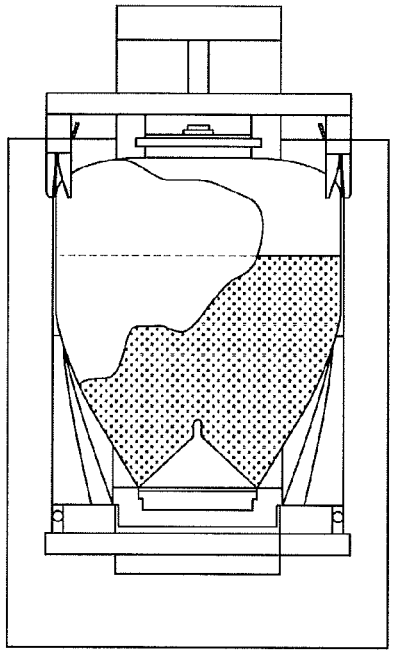
FIG. 2d (Prior Art)

FIG. 2*a* shows the IBC clamped, ready for blending. Blending takes place by tumbling the IBC end over end, on an asymmetric axis, causing the contents to flow over each other. FIGS. 2*b* and 2*c* show the start of the blend cycle and the blender running, respectively. FIG. 2*d* illustrates the IBC ready for unloading.

An operator panel (not shown) is provided to include controls for Start, Stop, Clamp, Unclamp, Reset and E-Stop, with Cycle Time and Rotating Speed displays as well as a Status lamp.

Referring now to FIGS. 3 to 18, there is illustrated apparatus 1 for mixing, according to a first embodiment of the invention, comprising a tumble blender adapted to receive and tumble a container 101 to mix the contents of the container, the apparatus 1 including drive means 13 for driving a mixer 23 (FIG. 6) of the container, the drive means being adapted to dock with the mixer when the container is received by the tumble blender to enable operation of the mixer by the drive means, the drive means being movably mounted, relative to the tumble blender, to facilitate docking of the drive means with the mixer.

Figure 3:
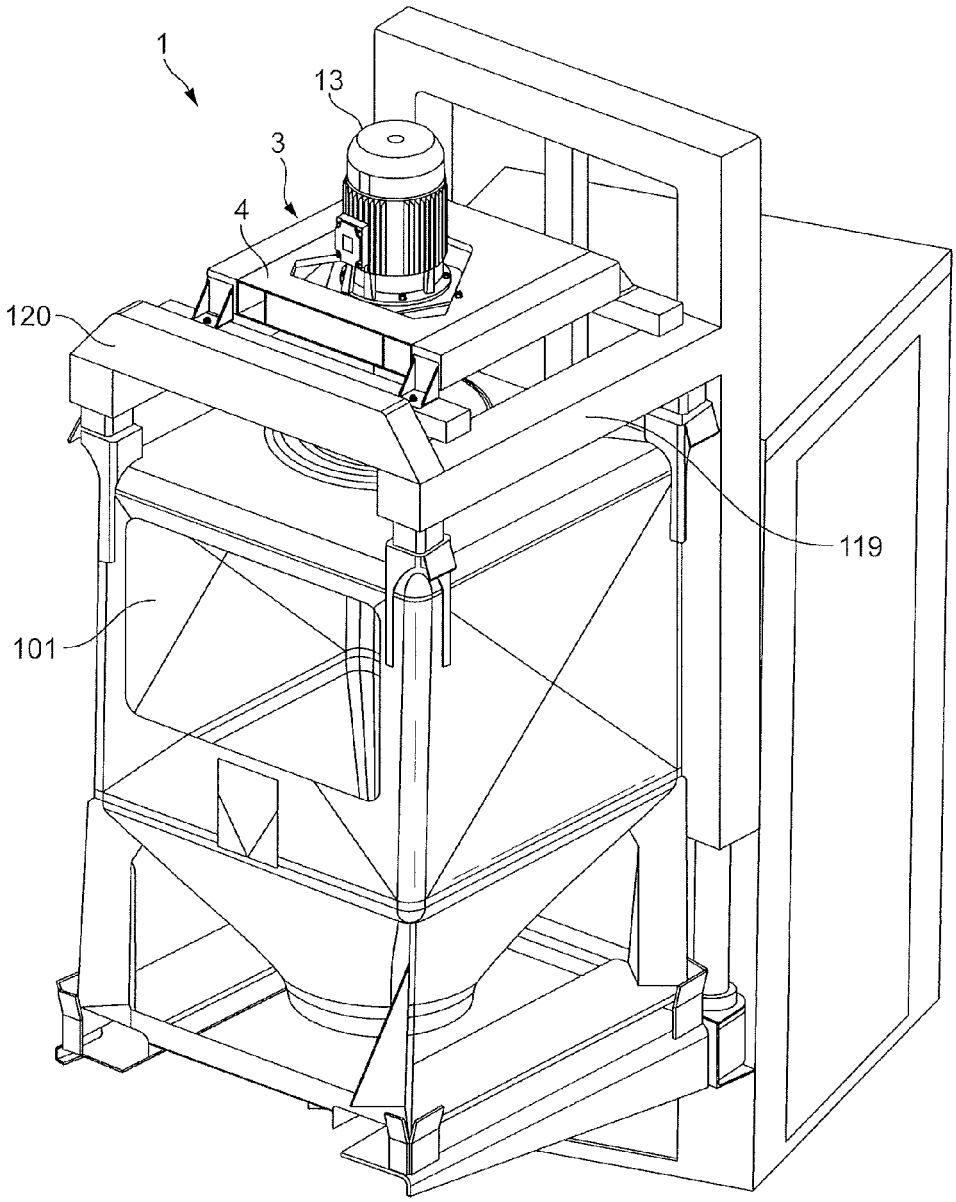
FIG. 3 is a front perspective schematic view of apparatus according to one aspect of the invention.
Figure 4:
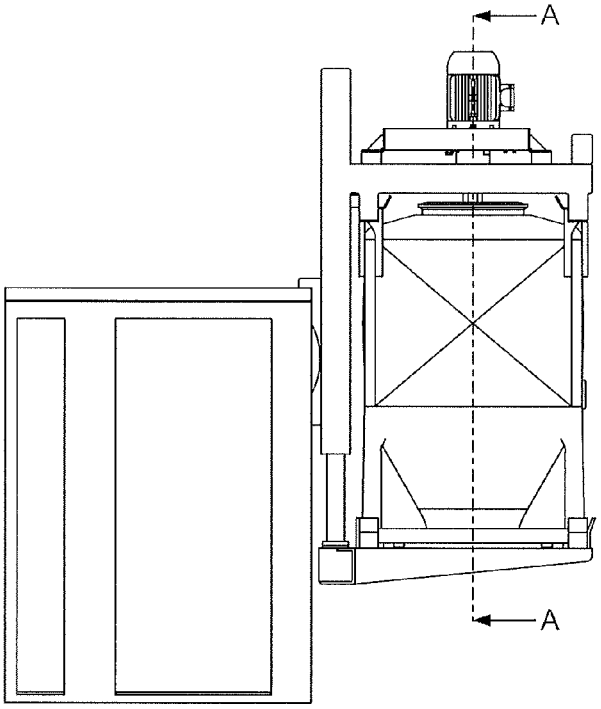
FIG. 4 is a side view of the apparatus of FIG. 3.
Figure 5:
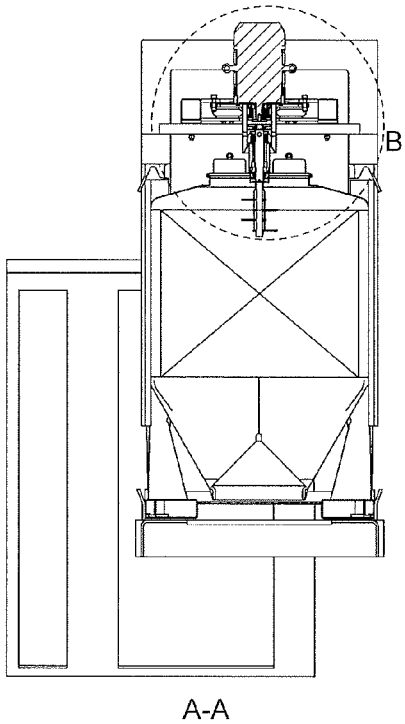
FIG. 5 is a front view of the apparatus of FIG. 3.

FIG. 3 is a schematic illustration of apparatus 1 according to one aspect of the invention. As can be seen, the basic components of the apparatus 1 are substantially similar to the prior art apparatus 100 described above, and like components will be described using the same reference numerals for the sake of clarity.

In the embodiment illustrated in FIG. 3, the apparatus 1 includes a top assembly 3. The top assembly 3 consists of a base 4 and a mixer drive assembly 13 and is mounted to upper frame side bars 119, effectively covering the gap between the side bars 119 and cross-piece 120. The top assembly 3 is thus placed such that it is above an IBC 101 when the IBC is in place in the apparatus 1.

Figure 7:
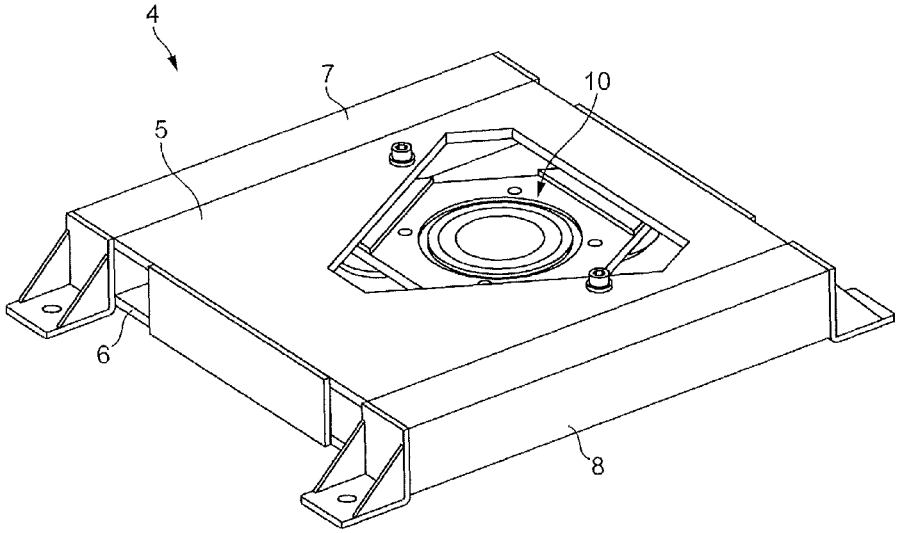
FIG. 7 is a perspective view of a part of the apparatus of FIG. 3.
Figure 8:
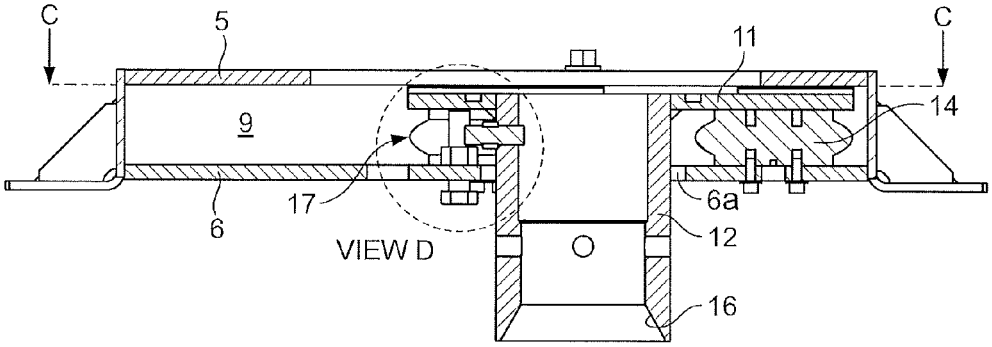
FIG. 8 is a sectional view of the part shown in FIG. 7.
Figure 9:
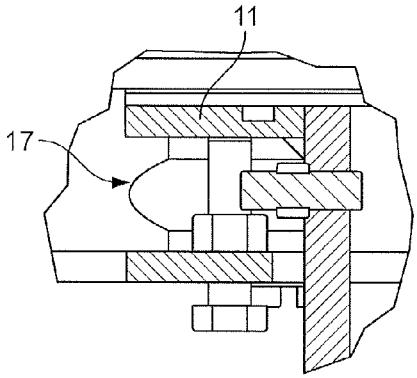
FIG. 9 is an enlarged view of area D in FIG. 8.
Figure 10:
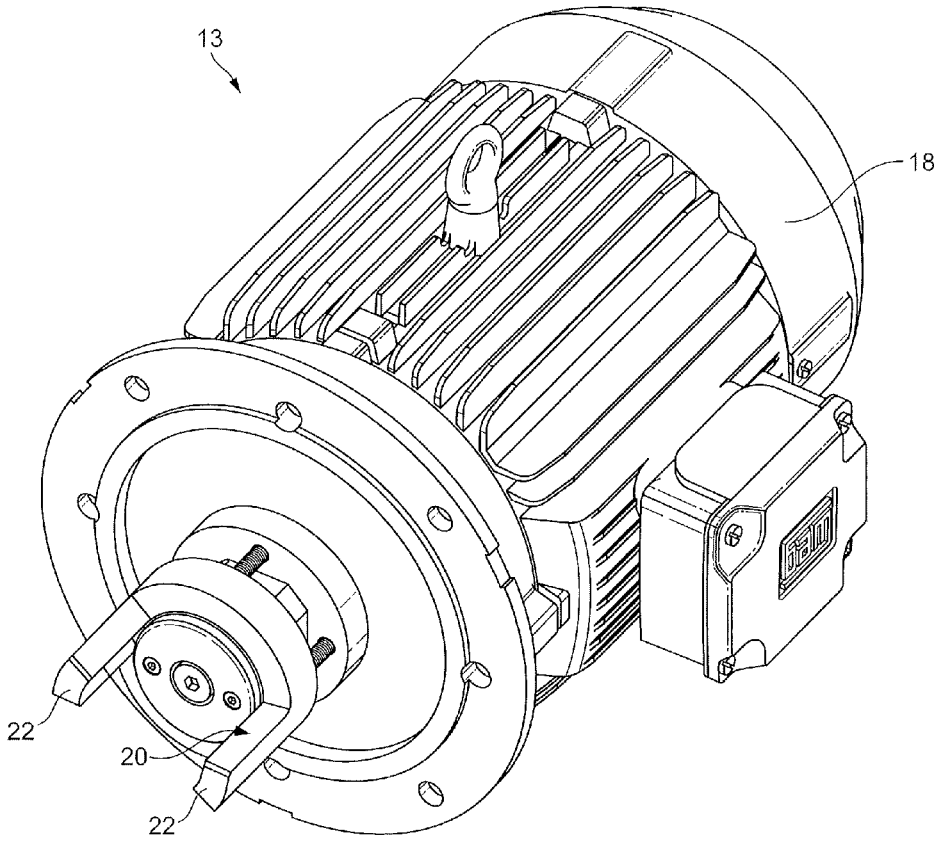
FIG. 10 is a perspective view of a part of the apparatus of FIG. 3.
Figure 11:
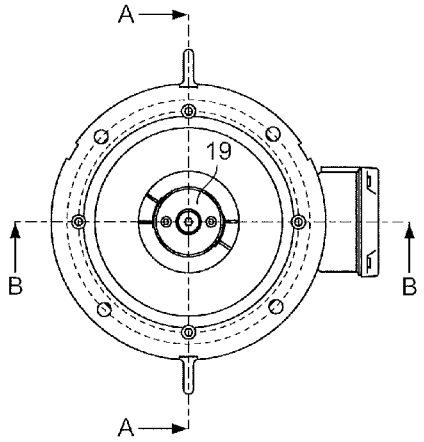
FIG. 11 is an end view of the part of FIG. 10.
Figure 12:
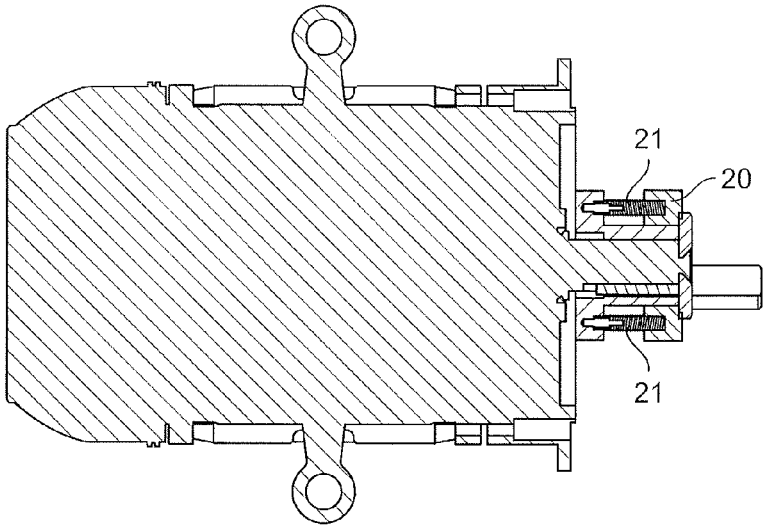
FIG. 12 is a sectional view along line A-A in FIG. 11.
Figure 13:
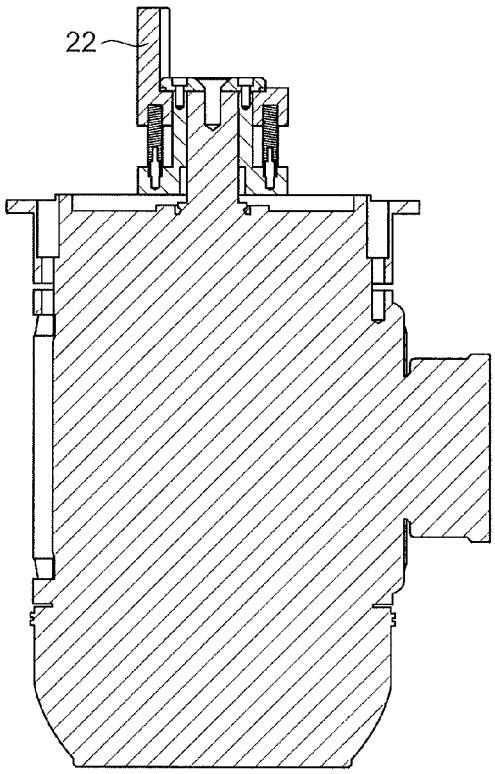
FIG. 13 is a sectional view along line B-B in FIG. 11.
Figure 14:
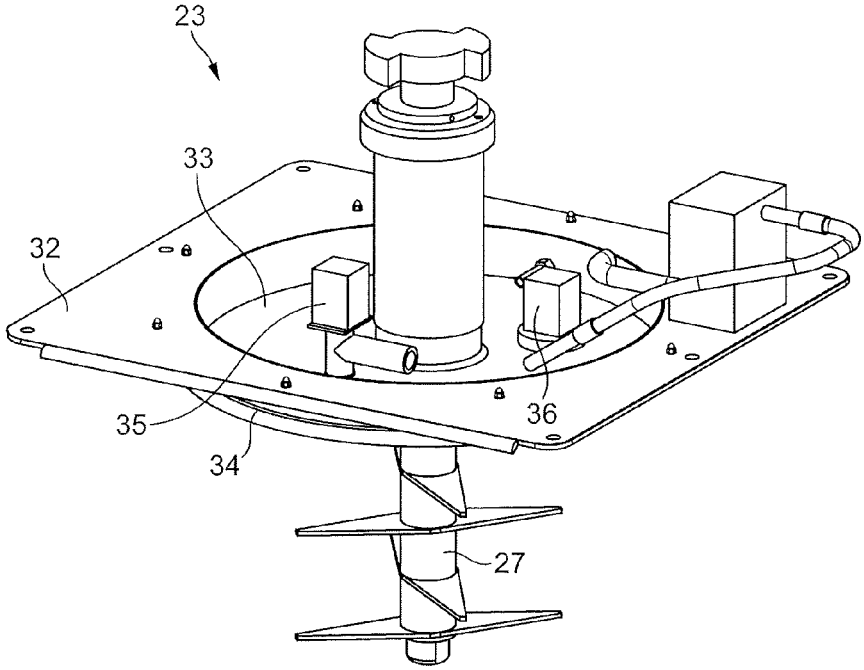
FIG. 14 is a perspective view of a first alternative part for use with the apparatus of FIG. 3.
Figure 15:
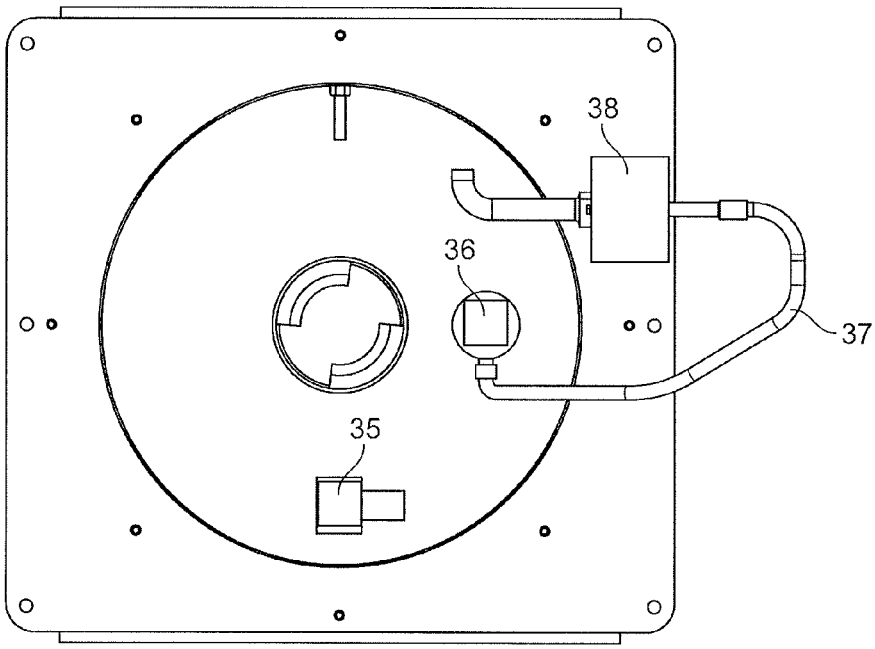
FIG. 15 is a plan view of the part of FIG. 14.
Figure 16:
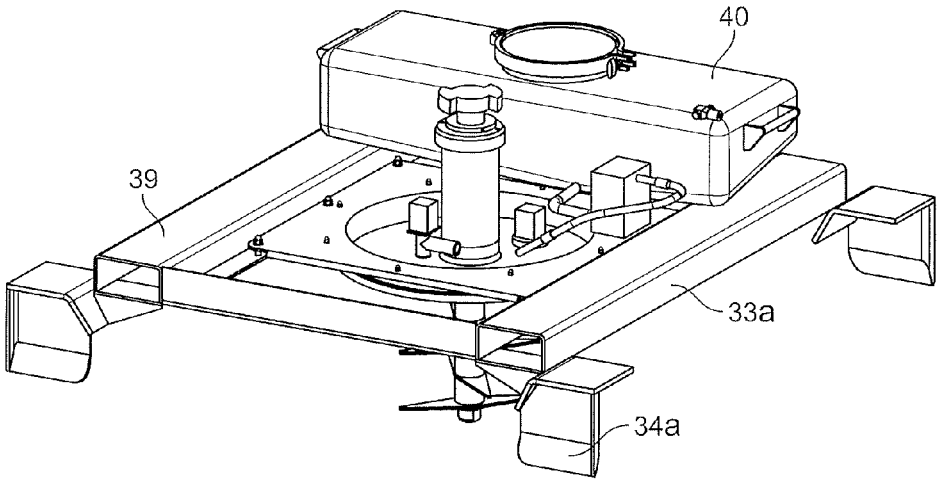
FIG. 16 is a perspective view of a support for use with the apparatus of FIGS. 14 and 15.
Figure 17:
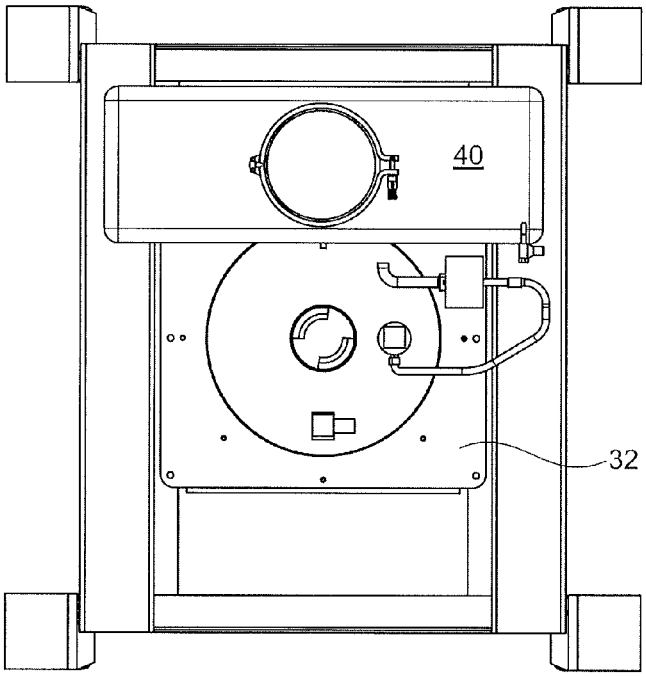
FIG. 17 is a plan view of the part of FIG. 16.

Referring now to FIGS. 7 to 9, one example of a movable mounting system for mounting drive means 13 is illustrated. The base 4 comprises upper and lower (as viewed) square plates 5,6 (FIG. 8) and the plates 5,6 are disposed one above the other and parallel to one another between side box-section girders 7,8 such that a space 9 is defined between the plates. Upper plate 5 defines a roughly triangular central aperture 10. The lower (as viewed) surface of the upper plate 5 has a mounting plate 11 (FIG. 9) moveably attached thereto by means of bolts 130, the mounting plate 11 mounting a dependent guide cylinder 12 that extends downwardly through and out of a correspondingly sized circular aperture 6*a* in lower plate 6. The mounting plate 11 is mounted so as to allow it to move laterally, relative to the base 4, the extent of lateral movement being limited by the size of the gap between the wall of the dependent guide cylinder 12 and the wall of the aperture 6*a*. Three pneumatic bellows type clamps 14 are provided between the mounting plate 11 and lower plate 6 (FIG. 8). Referring in particular to FIG. 8, the inner surface 16 of the mouth of guide cylinder 12 is inwardly tapered.

Referring now to FIG. 9, a sensor 17 in the form of an inductive proximity switch of known type is provided between the mounting plate 11 and lower plate 6, mounted through the wall of guide cylinder 12 for sensing into the interior of guide cylinder 12.

As mentioned, in addition to the base 4, the top assembly 3 also includes a mixer drive assembly 13, as shown in detail in FIGS. 6 and 10 to 13. The mixer drive assembly 13 comprises a motor 18 of generally known type, with a drive shaft 19 that includes an annular mating part 20. The annular mating part 20 comprises a square section ring with, as viewed, a flat front circumference 20*a* having two equally spaced drive projections 22 extending therefrom in a direction parallel with the axis of rotation of the drive shaft 19. The annular mating part 20 is slidable axially along the drive shaft 19 but is biased towards the distal end of the drive shaft (being the end remote from the motor) by springs 21.

Figure 6:
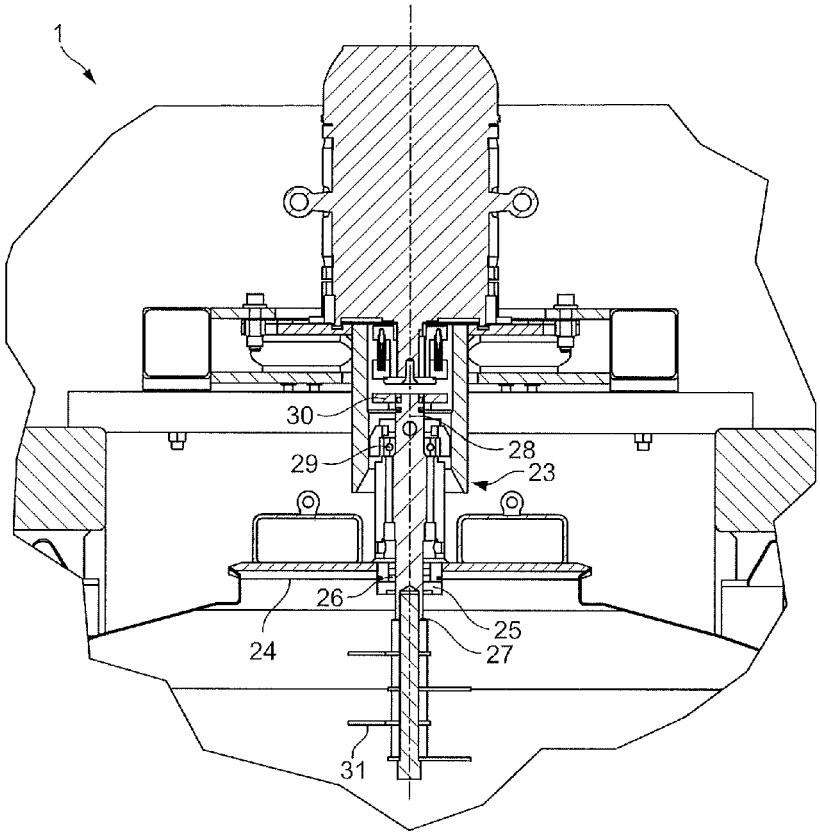
FIG. 6 is an enlargement of cut-away part B of FIG. 5.

Referring now to FIG. 6, it can be seen that apparatus 1 includes a first embodiment of obturating mixer 23. Obturating mixer 23 comprises a circular plate 24 dimensioned to fit within and seal with the inlet aperture of a container containing contents to be mixed. The plate has a depending flange (not shown) that includes a deformable sealing ring of known type. The centre of the plate 24 is formed with an aperture into which is welded a tube 25 including bearings 26 and a mixer shaft 27 mounted for rotation thereon. At its top (as viewed) the mixer shaft 27 terminates in drive coupling 28. Drive coupling 28 includes tapered guide boss 29 and two driving lugs 30 that extend opposite one another and laterally with respect to the axis of rotation of the mixer shaft 27 from the circumference of the shaft so that in section the shaft has the appearance of a "T". At its bottom (as viewed) end the shaft 27 is provided with a plurality of mixing blades 31.

Referring now to FIGS. 14 to 17, an alternative form of obturating mixer 23 is illustrated. Here, the mixer shaft 27 is mounted in a similar fashion as described above, but this time it is mounted into a square plate 32 which has a circular recess 33 that protrudes from the bottom surface (as viewed) of the plate 32 to form a circular closure for a container. The closure is provided with a seal 34, in this case an inflatable seal. The plate is provided with a pressure release valve 35 and a fluid inlet nozzle 36 with inlet flow pipe 37 attached to a pump 38.

The plate 32 is mounted on a square frame 33*a* (FIG. 16), the frame being provided with formations 34*a* that correspond in position to and are complementary in shape to stacking features 109 that may be present on a container 101, such as those illustrated on the container in FIG. 1. These formations 34*a* aid in location but are not essential to correct operation of the apparatus. The frame 33 includes two parallel box girders 39 (which also act as fork channels for a fork-lift device) onto which is mounted a fluid holding tank 40.

Figure 18:
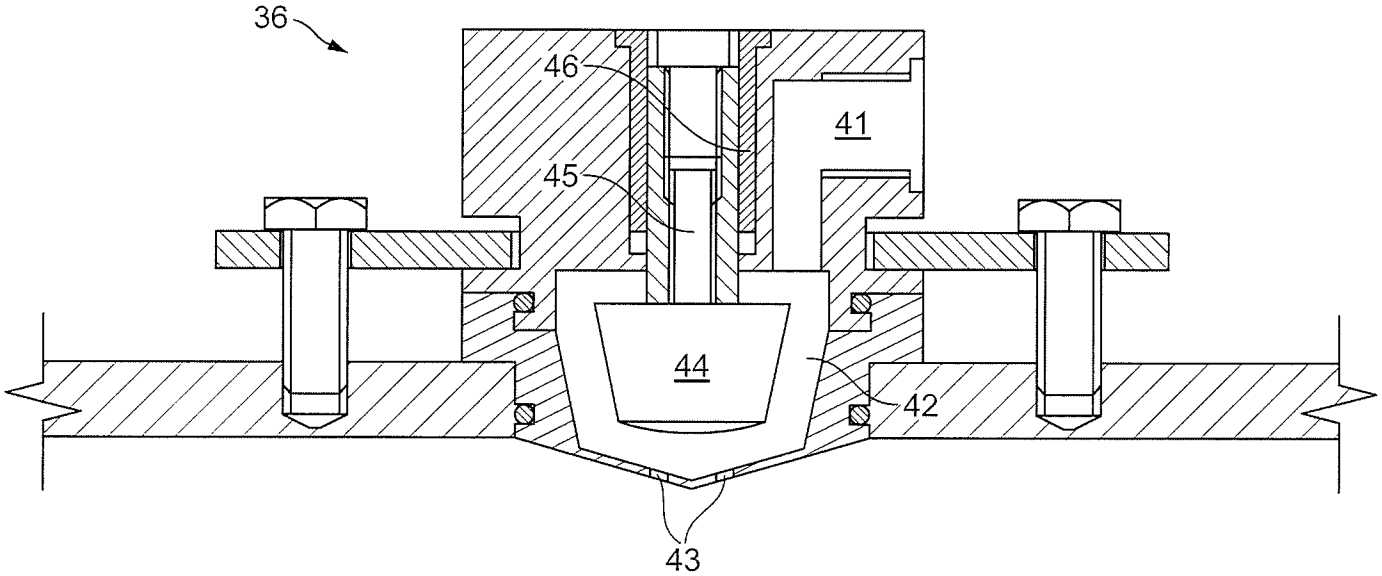
FIG. 18 is a sectional view of a nozzle for use with either of the parts shown in FIGS. 14 to 17.

Referring to FIG. 18, there is illustrated a sectional view of fluid inlet nozzle 36. The nozzle 36 includes an inlet 41 in fluid communication with a chamber 42 and outlet ports 43. Chamber 42 accommodates a closure buffer 44 mounted on a piston 45 reciprocably slidable within a cylinder 46 to the extent that the buffer 44 can obturate the ports 43 at the end of the cylinder's stroke downwardly, as viewed. The proximal end of the cylinder has means for connection of an air line (not shown).

Referring to the embodiment illustrated in FIGS. 3 to 6, in use, contents to be mixed are contained within container 101. Prior to mixing, the lid 107 is replaced by obturating mixer 23, which fits into and seals inlet 102. The container 101 is then clamped in place as described above, however, in this case, as the container moves upwards, as viewed, the mixer shaft 27 is received into the guide cylinder 12. This is the docking sequence. Correct entry into guide cylinder 12 is assisted by the tapered inner surface 16 of the guide cylinder 12 and the shoulders of the tapered guide boss 29. As will be appreciated, if the mixer shaft 27 and guide cylinder 12 are not correctly axially aligned, the mixer shaft 27, mainly by the shoulders of the guide boss 29 acting on the tapered inner surface 16 and will cause the mixer drive assembly 13 as a unit to move laterally, relative to the blender to achieve correct alignment. As the container 101 rises, the drive coupling 28 of the mixer 23 engages with the sprung annular mating part 20 of the motor 18. It will be appreciated that for drive to occur, the drive projections 22 and driving lugs 30 must mesh. As a further expedient to aid in correct docking, if the two parts of the coupling are not correctly rotationally aligned, the sprung annular mating part 20 will be deflected upwardly by the lugs against the force of the springs 21, and the sensor 17 notes this deflection.

Once docking and clamping are complete, rotation can be initiated. At this point, or at some subsequent point during mixing, the motor 18 can be activated to enhance mixing. When the motor 18 is activated, it is started up to rotate initially slowly. This allows the coupling between the motor 18 and the obturating mixer 23 to be aligned, the springs 21 providing completion of engagement which is confirmed by loss of signal from the sensor 17. However, if the sensor signal remains after a certain pre-set time, the operation aborts and the apparatus 1 returns the container to a parked position so that the fault can be addressed.

Without providing for correct lateral alignment between the heavy container 101 full of premix and the drive motor 18 mounted in the rigid blender cage 3, large and undesirable stresses on the components of the apparatus 1 may result, leading to excessive wear and even dangerous failure. For this reason, the drive motor 18 is mounted on the blender such that its mounting plate 11 has a limited degree of lateral movement, as described above. However, when docked, with the cage 3 rotating, it is also undesirable for the weight of the motor 18 to be restrained only by the welded tube 25 of the obturating mixer 23. For this reason the apparatus 1 is provided with means to clamp the mounting plate 11 to the upper plate 5 of the base 4 in the form of the pneumatic bellows type clamps 14 which prevents movement of the motor assembly relative to the blender during rotation.

If it is desired to add fluid, such as a liquid constituent, during mixing, an obturating mixer 23 such as that illustrated in FIGS. 14 to 17 can be used. Fluid can be fed by starting pump 38 which feeds fluid to nozzle 36 and from there, onto the surface of the contents of the container 101 or otherwise thereinto as desired. The nozzle 36 is adapted to provide adequate flow pattern whilst being immersed in tumbling constituents without the ports 43 being blocked. In use, the buffer 44 is moved pneumatically, via the piston 45 and cylinder 46 to close or open the ports as desired.

The invention claimed is:

1. Apparatus for mixing, comprising a tumble-blender adapted to receive and tumble a container to mix the contents of the container, the apparatus including a mixer, drive means for driving the mixer, the drive means being adapted to dock with the mixer when the container is received by the tumble-blender to enable operation of the mixer by the drive means, wherein the apparatus comprises a top assembly comprising a base comprising upper and lower plates, the lower surface of the upper plate having a mounting plate movable thereto and mounted on bolts, the mounting plate mounting a dependent guide cylinder that extends downwardly through and out of a correspondingly sized circular aperture in the lower plate; the apparatus further comprising pneumatic bellows clamps provided between the mounting plate and the lower plate; wherein the mixer comprises a mixer shaft comprising a tapered guide boss adapted to be received by the guide cylinder provided on the mounting plate, and wherein the drive means comprises a drive motor; wherein the correct alignment of the drive means with the mixer is assisted by the tapered inner surface of the guide cylinder and the shoulders of the tapered guide boss, such that the drive means is movable laterally, relative to the tumble-blender, to facilitate docking of the drive means with the mixer; wherein the mounting plate is mounted so as to allow it to move laterally, relative to the base, the extent of lateral movement being limited by the size of the gap between the wall of the dependent guide cylinder and the wall of the aperture; and wherein the drive motor is mounted on the blender such that the mounting plate has a limited degree of lateral movement.

2. Apparatus according to claim 1, wherein the drive means is adapted to drive a rotatable mixer of the container.

3. Apparatus according to claim 1, wherein the drive means is movable by a part of a mixer of the container.

4. Apparatus according to claim 1, including means to prevent movement of the drive means relative to the blender, after docking has occurred.

5. Apparatus according to claim 1, the tumble-blender including receiving means for receiving the container for tumble-blending, the receiving means being mounted to a non-moving support to move the container on an asymmetric axis.

6. Apparatus according to claim 5, wherein the receiving means comprises a frame, the frame being adapted to clamp containers of different sizes.

7. Apparatus according to claim 1, further comprising a closure adapted to obturate an aperture of a container for mixing, the closure including a mixer for mixing the contents of the container, the drive means being adapted to dock with the mixer when the container is received by the tumble-blender to enable operation of the mixer by the drive means.

8. Apparatus according to claim 7, the mixer comprising a rotatable mixer.

9. Apparatus according to claim 8, the drive means and the mixer including mutually interengagable and releasable rotational coupling means.

10. Apparatus according to claim 9, including means adapted to provide for correct engagement of the coupling means.

11. Apparatus according to claim 10, wherein the correct engagement means is adapted to provide for correct rotational adjustment of the rotational coupling means.

12. Apparatus according to claim 11, the correct engagement means comprising a sensor to sense the relative positions of the rotational coupling means and control means adapted to control the speed of rotation of the drive means on start-up such that correct rotational adjustment of the coupling means occurs.

13. Apparatus according to claim 12, the rotational coupling means comprising, on the drive means, a linearly reciprocable drive-shaft rotatable about an axis of rotation and including one or more drive projection projecting substantially parallel with the said axis of rotation, and on a blade means, a rotatable drive shaft comprising one or more driving lug disposed to mesh with the drive projection when correct rotational adjustment is achieved, a sensor means being adapted to sense the position of a part of the coupling means along the said axis of rotation.

14. Apparatus according to claim 7, the closure including means for fluid dosing of the container.

15. Apparatus according to claim 14, the fluid dosing means including a nozzle, the nozzle comprising an inlet for fluid in fluid communication with at least one port for dosing of fluid into the container, and a closure for the ports, operable to close the ports from within the nozzle.

16. Apparatus according to claim 1, wherein the drive means comprises a linearly reciprocable drive shaft and wherein the apparatus comprises a sensor means adapted to sense the relative positions of the drive means and mixer and to provide for correct engagement.

* * * * *